US009137601B2

(12) United States Patent
Kuo

(10) Patent No.: US 9,137,601 B2
(45) Date of Patent: Sep. 15, 2015

(54) AUDIO ADJUSTING METHOD AND ACOUSTIC PROCESSING APPARATUS

(71) Applicant: AVer Information Inc., New Taipei (TW)

(72) Inventor: Yan-Min Kuo, New Taipei (TW)

(73) Assignee: AVER INFORMATION INC., New Taipei (TW)

( * ) Notice: Subject to any disclaimer, the term of this patent is extended or adjusted under 35 U.S.C. 154(b) by 291 days.

(21) Appl. No.: 13/834,824

(22) Filed: Mar. 15, 2013

(65) Prior Publication Data

US 2014/0153741 A1 Jun. 5, 2014

(30) Foreign Application Priority Data

Dec. 3, 2012 (TW) ..... 101145304 A

(51) Int. Cl.
*H04R 3/02* (2006.01)

(52) U.S. Cl.
CPC ..... *H04R 3/02* (2013.01)

(58) Field of Classification Search
CPC ..... H04R 3/02; H04S 7/301; H03G 3/32
USPC ..... 381/93, 94.1, 5, 7, 317, 318, 321; 700/94
See application file for complete search history.

(56) References Cited

U.S. PATENT DOCUMENTS

2011/0251704 A1* 10/2011 Walsh et al. ..... 700/94
2013/0094656 A1* 4/2013 Fung ..... 381/57

FOREIGN PATENT DOCUMENTS

TW 201142831 12/2011

OTHER PUBLICATIONS

Taiwan Intellectual Property Office. "Office Action", Jul. 8, 2014.

* cited by examiner

*Primary Examiner* — Melur Ramakrishnaiah
(74) *Attorney, Agent, or Firm* — WPAT, PC; Justin King

(57) ABSTRACT

An acoustic processing apparatus and an audio adjusting method for the acoustic processing apparatus are provided. The acoustic processing apparatus is electrically connected with a microphone and a speaker. The acoustic processing apparatus includes an input unit, a storing unit, a computing unit, an adjusting unit, and an output unit. The audio adjusting method includes steps of: receiving a feedback audio from the microphone, calculating a current residue audio according to the feedback audio, a stored residue audio and an offset parameter, performing a correlation calculation to find out a relationship between the feedback audio and the stored residue audio, selectively modifying the offset parameter according to a result of the correlation calculation, and outputting the current residue audio to the speaker.

10 Claims, 5 Drawing Sheets

AUDIO ADJUSTING METHOD AND ACOUSTIC PROCESSING APPARATUS

This application claims the benefit of Taiwan Patent Application No. 101145304, filed Dec. 3, 2012, the subject matter of which is incorporated herein by reference.

FIELD OF THE INVENTION

The present invention relates to an audio adjusting method and an acoustic processing apparatus, and more particularly to an audio adjusting method and an acoustic processing apparatus for selectively modifying an adjusting margin of an offset parameter.

BACKGROUND OF THE INVENTION

A sound reinforcement system is a widely-used device in the modern society. However, when the sound from a speaker gets back to a microphone, an acoustic feedback occurs. The acoustic feedback is detrimental to the performance of the sound reinforcement system.

FIG. 1 schematically illustrates the architecture of a conventional sound reinforcement system. As shown in FIG. 1, the sound reinforcement system includes a microphone 13 and a speaker 15. When a sound such as "1, 2, 3 . . . " is issued by a user 11, the sound is received by the microphone 13, then amplified, and finally outputted from the speaker 15.

However, at the time when the sound is received by the microphone 13, the amplified sound is simultaneously outputted from the speaker 15. The sound from the speaker 15 is also received by the microphone 13. That is, the feedback audio received by the microphone 13 includes two separate sounds. The two sounds include a target audio originated from the user 11 and a background audio from the speaker 15.

The loop of receiving, amplifying and outputting the sound may result in the acoustic feedback and the acoustic divergence. When the acoustic feedback occurs, the speaker is readily damaged. The acoustic feedback may lead to a howling sound, which is unpleasant to the user 11 and the listener.

Conventionally, a low-sensitivity microphone is used to prevent the microphone from receiving the background audio in order to reduce the influence of the acoustic feedback. Although the use of the low-sensitivity microphone can solve the problems of resulting in the acoustic feedback and the howling sound, there are still some drawbacks. For example, since the low-sensitivity microphone is only able to receive the sound at a very short distance, the microphone has to be located near the mouth of the user. Generally, since the low-sensitivity microphone is a handheld microphone, a neck-worn microphone or a head-worn microphone, the use of the low-sensitivity microphone is inconvenient.

Moreover, since the microphone is located near the mouth of the user, the droplets and the saliva of the user are readily retained on the microphone. In other words, the use of the low-sensitivity microphone is unsanitary.

In accordance with another way of reducing the influence of the acoustic feedback, the sound volume of the speaker is decreased or the microphone is placed far from the speaker. Consequently, the influence of the sound from the speaker on the sound-receiving performance of the microphone is reduced. However, since the sound volume of the speaker is decreased, the efficacy of amplifying the sound by the speaker is impaired. Moreover, in many situations, the position of the speaker cannot be arbitrarily moved.

Therefore, there is a need of providing an audio adjusting method and an acoustic processing apparatus in order to reduce the influence of the acoustic feedback of the reinforcement system.

SUMMARY OF THE INVENTION

An embodiment of the present invention provides an audio adjusting method for an acoustic processing apparatus. The acoustic processing apparatus is electrically connected with a microphone and a speaker. The audio adjusting method includes steps of receiving a feedback audio from the microphone, calculating a current residue audio according to the feedback audio, a stored residue audio and an offset parameter, performing a correlation calculation to find out a relationship between the feedback audio and the stored residue audio, selectively modifying the offset parameter according to a result of the correlation calculation, and outputting the current residue audio to the speaker.

Another embodiment of the present invention provides an acoustic processing apparatus. The acoustic processing apparatus is electrically connected with a microphone and a speaker. The acoustic processing apparatus includes an input unit, a storing unit, a computing unit, an adjusting unit, and an output unit. The input unit is used for receiving a feedback audio from the microphone. The storing unit is used for storing a stored residue audio and an offset parameter. The computing unit is electrically connected with the input unit and the storing unit for calculating a current residue audio according to the feedback audio, the stored residue audio and the offset parameter, and performing a correlation calculation to find out a relationship between the feedback audio and the stored residue audio. The adjusting unit is electrically connected with the computing unit for selectively modifying the offset parameter according to a result of the correlation calculation. The output unit is electrically connected with the computing unit for outputting the current residue audio to the speaker.

Numerous objects, features and advantages of the present invention will be readily apparent upon a reading of the following detailed description of embodiments of the present invention when taken in conjunction with the accompanying drawings. However, the drawings employed herein are for the purpose of descriptions and should not be regarded as limiting.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

As previously described, when the microphone is used to receive a sound, a target audio from the user and a background audio from the speaker are simultaneously received by the microphone. The present invention provides an audio adjusting method. After the feedback audio received from the microphone is processed by the acoustic processing apparatus, a current residue audio is outputted to the speaker. The current residue audio is calculated according to the feedback audio, a stored residue audio and an offset parameter. After the audio adjusting method is performed, a great portion of the background audio is deducted from the feedback audio. Consequently, the possibility of causing the howling sound is largely reduced.

Figure 1:
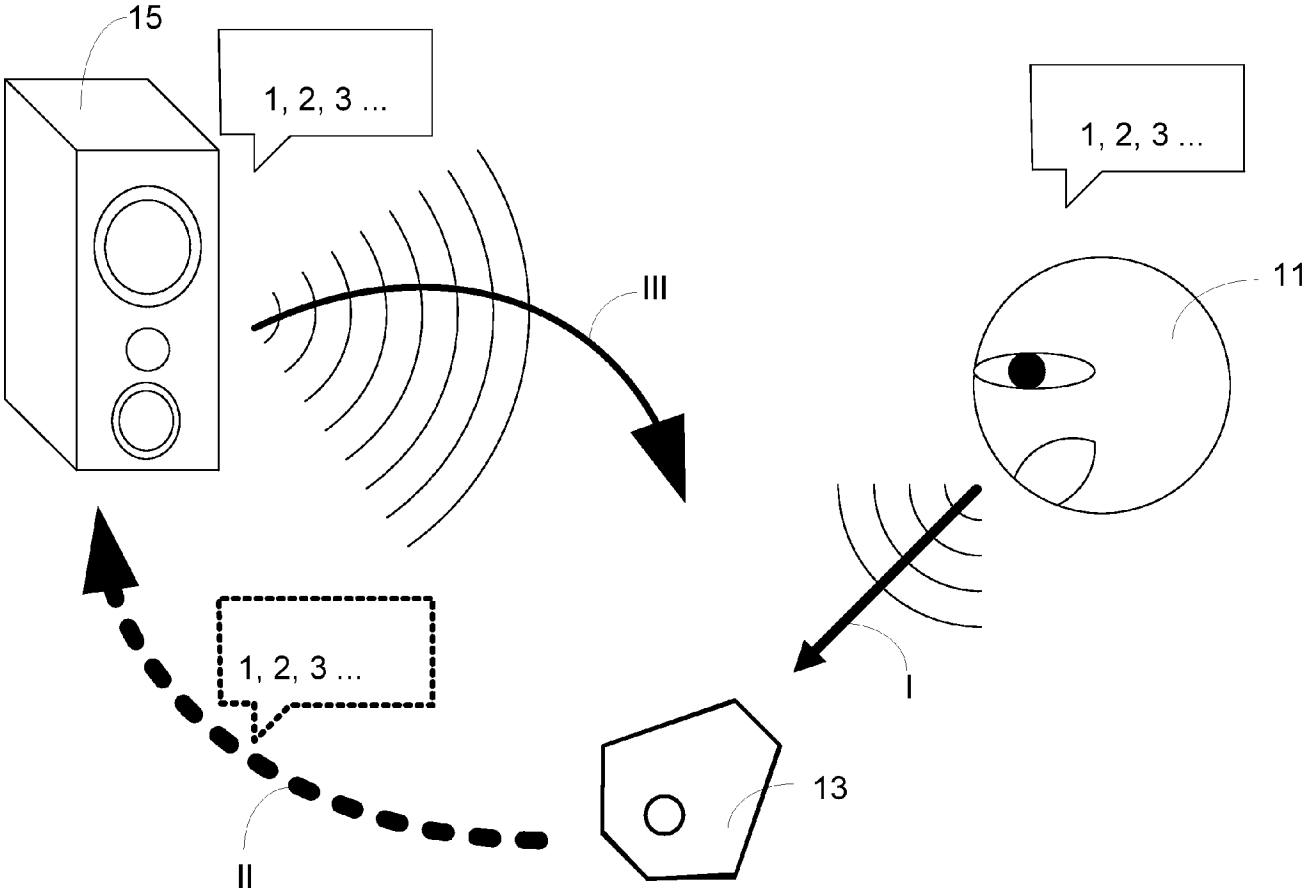
FIG. 1 (PRIOR ART )
FIG. 1 (prior art) schematically illustrates the architecture of a conventional sound reinforcement system.
Figure 2:
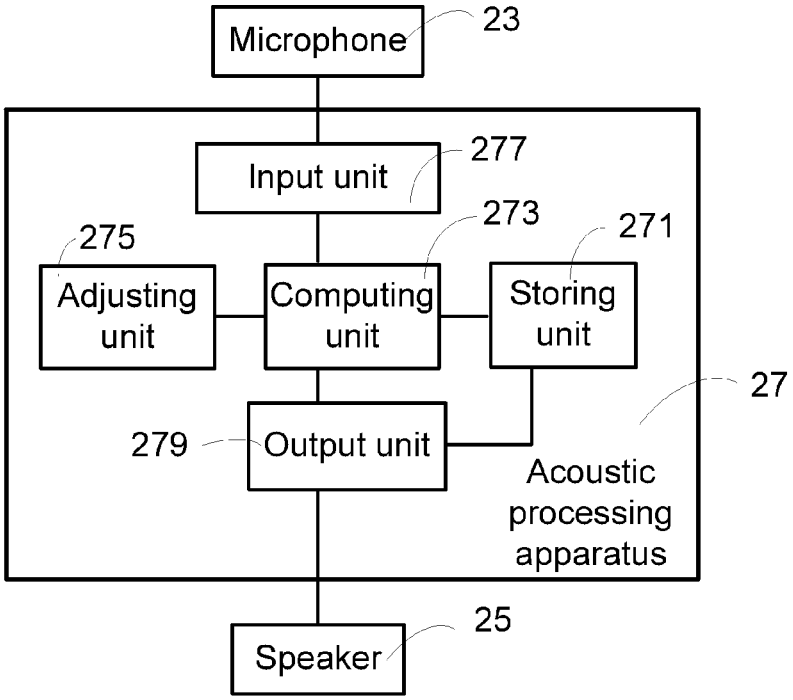
FIG. 2 is a schematic functional block diagram illustrating a sound reinforcement system with an acoustic processing apparatus of the present invention.

FIG. 2 is a schematic functional block diagram illustrating a sound reinforcement system with an acoustic processing apparatus of the present invention. The acoustic processing apparatus 27 has an input unit 277 in communication with a microphone 23, and an output unit 279 in communication with a speaker 25.

Moreover, the acoustic processing apparatus 27 further includes a storing unit 271, a computing unit 273 and an adjusting unit 275. The computing unit 273 is electrically connected with the input unit 277, the output unit 279, the storing unit 271 and the adjusting unit 275.

Figure 3:
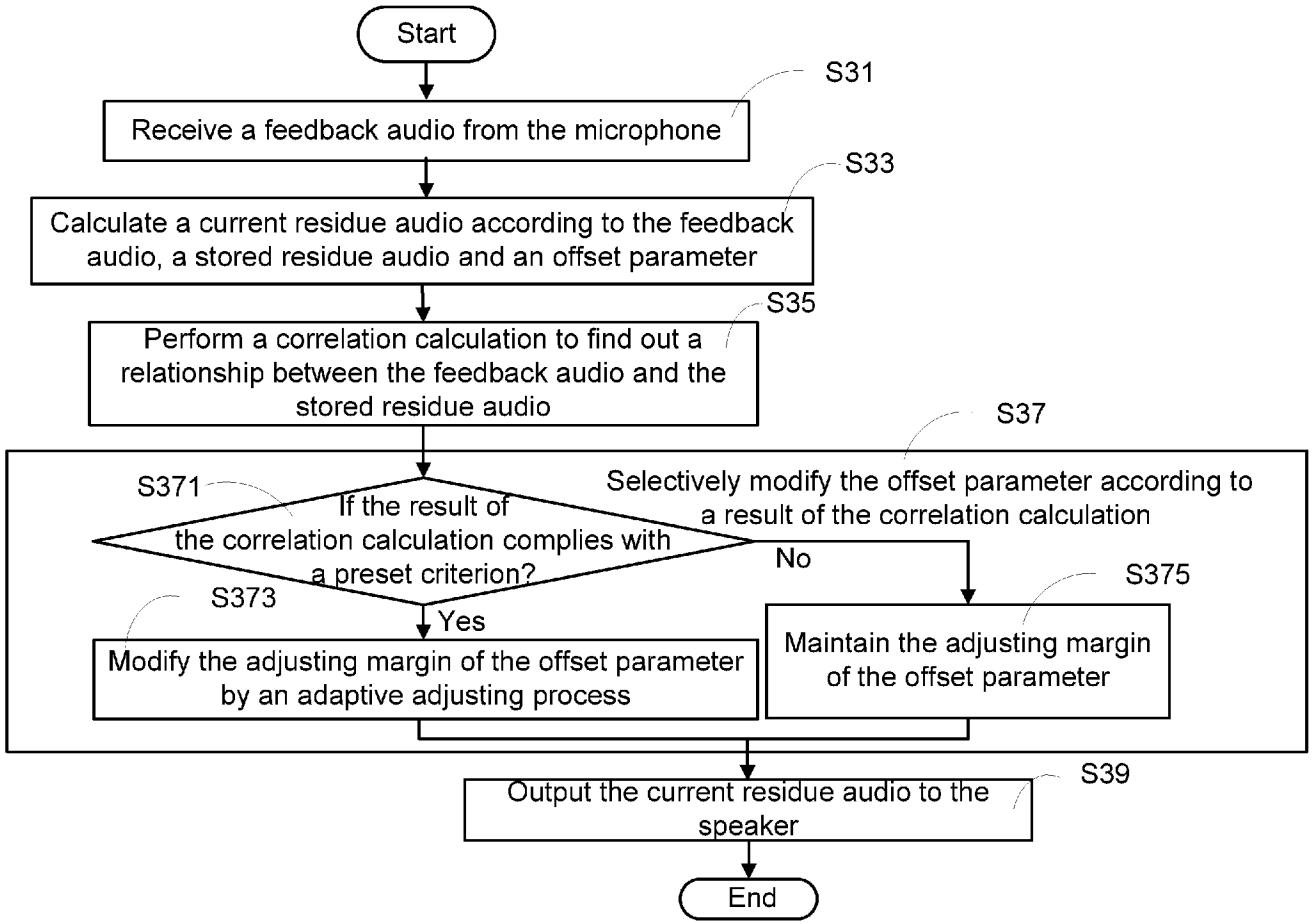
FIG. 3 is a flowchart illustrating an audio adjusting method for the acoustic processing apparatus according to an embodiment of the present invention.

FIG. 3 is a flowchart illustrating an audio adjusting method for the acoustic processing apparatus according to an embodiment of the present invention.

Firstly, a feedback audio is received from the microphone (Step S31). That is, when the microphone 23 is used by the user, a feedback audio F including the target audio and the background audio is continuously received by the microphone 23. As the sound reinforcement system is continuously used, the feedback audio F from the microphone 23 is continuously transmitted to the input unit 277 of the acoustic processing apparatus 27.

Then, the storing unit 271, the computing unit 273 and the adjusting unit 275 of the acoustic processing apparatus 27 are used to perform an acoustic echo cancellation (hereinafter, AEC) process including the steps S33, S35 and S37 in order to cancel the echo caused by the feedback audio F.

For performing the AEC process, the acoustic processing apparatus 27 calculates a current residue audio according to the feedback audio, a stored residue audio and an offset parameter (Step S33). The acoustic processing apparatus 27 also performs a correlation calculation to find out the relationship between the feedback audio and the stored residue audio (Step S35). And, the offset parameter is selectively modified according to the result of the correlation calculation (Step S37).

The step S37 further includes sub-steps S371, S373 and S375. The sub-step S371 is performed to judge whether the result of the correlation calculation complies with a preset criterion. If the result of the correlation calculation does not comply with the preset criterion, the adjusting margin of the offset parameter is maintained (S375). If the result of the correlation calculation complies with the preset criterion, the adjusting margin of the offset parameter is adjusted by an adaptive adjusting process (S373).

For example, in the sub-step S371, the preset criterion is satisfied when the result of the correlation calculation is higher than or equal to 0.7. On the other hand, preset criterion is not satisfied when the result of the correlation calculation is lower than 0.7.

After the AEC process is performed, the non-target audio component of the feedback audio F is decreased by the acoustic processing apparatus 27. That is, the received feedback audio F is not directly provided to the speaker 25. Only after the feedback audio F is processed by the acoustic processing apparatus 27, a current residue audio Rnew is provided to the speaker 25. Consequently, the current residue audio Rnew is transmitted to the speaker 25 through the output unit 279 and outputted from the output unit 279 (S39).

After the audio adjusting method is performed, the current residue audio Rnew is produced by deducting a great portion of the background audio component from the feedback audio F. Consequently, the possibility of causing the howling sound is largely reduced. Moreover, it takes only about 20 milliseconds to perform the flowchart of the audio adjusting method as shown in FIG. 3. The feedback audio can be adjusted efficiently.

The operating principles of performing the AEC process to process the feedback audio F, and producing the current residue audio Rnew by the acoustic processing apparatus 27 will be illustrated in more details as follows.

Figure 4:
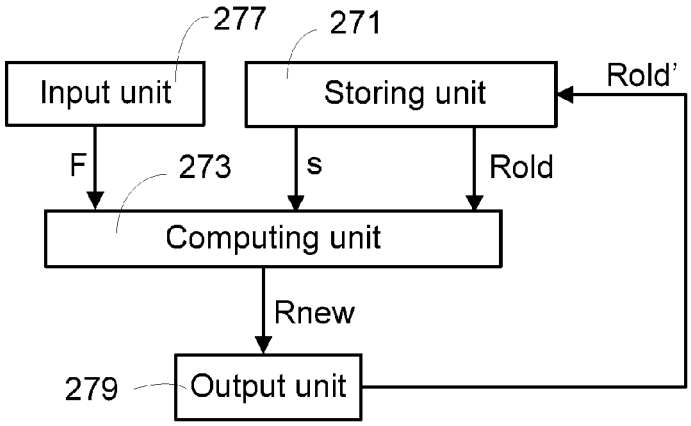
FIG. 4 schematically illustrates the process of performing the step S33 of FIG. 3 by the acoustic processing apparatus of the present invention.

FIG. 4 schematically illustrates the process of performing the step S33 of FIG. 3 by the acoustic processing apparatus of the present invention.

Firstly, a stored residue audio Rold is transmitted from the storing unit 271 to the computing unit 273, and the feedback audio F is transmitted from the input unit 277 to the computing unit 273.

The stored residue audio Rold is equivalent to the current residue audio Rnew that is obtained by the computing unit 273 at the previous audio adjusting cycle. For example, the current residue audio Rnew obtained at the time spot t(n−1) is used as the stored residue audio Rold at the time spot t(n). Similarly, the current residue audio Rnew obtained at the time spot t(n) is used as the stored residue audio Rold at the time spot t(n+1). The rest may be deduced by analogy.

Then, the current residue audio Rnew is calculated according to the feedback audio F, the stored residue audio Rold and the offset parameter s. For example, the current residue audio is calculated by the computing unit 273 according to formula (1): $Rnew=F-(s\times Rold)$. In the formula (1), Rnew denotes the current residue audio, F denotes the feedback audio, Rold denotes the stored residue audio, and s denotes the offset parameter.

After the current residue audio Rnew is calculated by the computing unit 273, the current residue audio Rnew is transmitted to the output unit 279 in order to be outputted from the speaker.

Then, the stored residue audio Rold in the storing unit 271 of the acoustic processing apparatus 27 is updated with the current residue audio Rnew. That is, Rold is updated with Rold', i.e. Rold'=Rnew.

Figure 5:
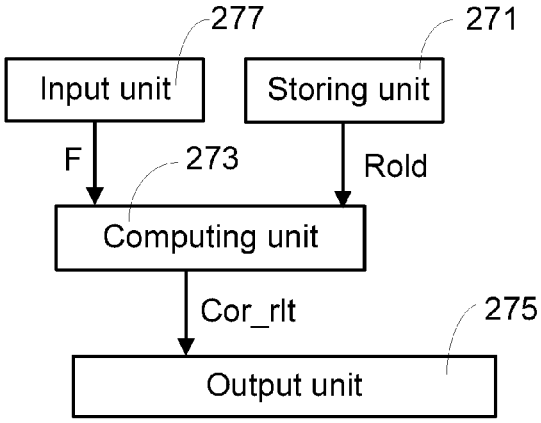
FIG. 5 schematically illustrates the process of performing the step S35 of FIG. 3 by the acoustic processing apparatus of the present invention.

FIG. 5 schematically illustrates the process of performing the step S35 of FIG. 3 by the acoustic processing apparatus of the present invention.

In the step S35 of FIG. 3, the computing unit 273 of the acoustic processing apparatus 27 perform a correlation calculation to find out the statistical relationship between the stored residue audio Rold (provided by the storing unit 271) and the feedback audio F (provided by the input unit 277).

The correlation calculation is used to find out the statistical relationship between the feedback audio F and the stored residue audio Rold according to the amplitude change, the spectrum response and the voiceprint data. Generally, the correlation calculation result Cor_rlt (also referred as a correlation coefficient) is in a range between −1 and +1. The value "−1" indicates a perfect negative correlation. The value "+1" indicates a perfect positive correlation In the step S371, the preset criterion is satisfied when the absolute value of the correlation calculation result Cor_rlt is higher than or equal to 0.7. The settings of the preset criterion may be varied according to the practical requirements. For example, in the acoustic technology, the absolute value of the correlation calculation result that is lower than 0.3 indicates a weak relationship. Consequently, in some other embodiments, the preset criterion is satisfied when the absolute value of the correlation calculation result Cor_rlt is higher than or equal to 0.3.

After the correlation calculation about the statistical relationship between the feedback audio F and the stored residue audio Rold is performed by the computing unit 273, the correlation calculation result Cor_rlt is transmitted to the adjusting unit 275.

Figure 6:
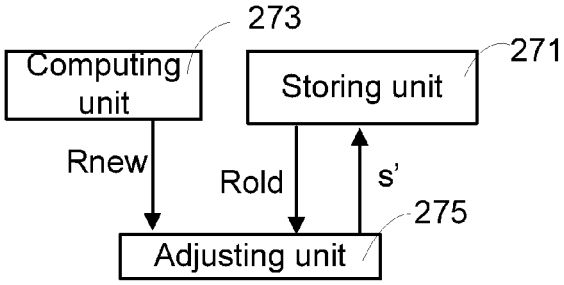
FIG. 6 schematically illustrates the adaptive adjusting process performed by the acoustic processing apparatus of the present invention.

FIG. 6 schematically illustrates the adaptive adjusting process performed by the acoustic processing apparatus of the present invention.

The offset parameter s is stored in the storing unit 271. Moreover, the current residue audio Rnew obtained at the previous time spot is used as the stored residue audio Rold at the current time spot and stored in the storing unit 271. The correlation calculation result Cor_rlt is also provided to the adjusting unit 275.

According to the formula (1), it is found that the magnitude of the current residue audio Rnew is dependent on the feedback audio F, the offset parameter s and the stored residue audio Rold. The magnitudes of the feedback audio F and the stored residue audio Rold are established values. Consequently, the adjustment of the current residue audio Rnew is only achievable by modifying the offset parameter s.

After the correlation calculation result Cor_rlt from the computing unit 273 is received by the adjusting unit 275, the adjusting unit 275 will judge whether the correlation calculation result Cor_rlt complies with the preset criterion (i.e. whether the absolute value of the correlation calculation result Cor_rlt is higher than or equal to 0.7). Moreover, according to the correlation calculation result Cor_rlt, the adjusting unit 275 will selectively modify the offset parameter s to a modified offset parameter s'.

In a case where the correlation calculation result Cor_rlt dose not comply with the preset criterion, it means that the feedback audio F and the stored residue audio Rold are not highly correlated. That is, the influence of the stored residue audio Rold on the feedback audio F is low. Under this circumstance, the offset parameter s is maintained by the adjusting unit 275.

In another case where the correlation calculation result Cor_rlt complies with the preset criterion, it means that the feedback audio F and the stored residue audio Rold are highly correlated. Under this circumstance, a higher fraction of the stored residue audio Rold should be deducted from the feedback audio F.

In the situation that the feedback audio F and the stored residue audio Rold are highly correlated, the current residue audio Rnew is adjusted by the adjusting unit 275 according to the adaptive adjusting process. Hereinafter, the reason why the adaptive adjusting process is needed will be illustrated by referring to the time spot t(n−1) and the time spot t(n).

The current residue audio Rnew obtained at the time spot t(n−1) is used as the stored residue audio Rold at the time spot t(n). The product of the stored residue audio Rold and the offset parameter s at the time spot t(n) may influence the current residue audio Rnew at the time spot t(n).

For reducing the influence of the stored residue audio Rold on the feedback audio F when the current residue audio Rnew is calculated at the time spot t(n), the offset parameter s should be modified at the time spot t(n−1).

That is, if the feedback audio F and the stored residue audio Rold are highly correlated at the time spot t(n−1), the adaptive adjusting process is performed to recursively change the adjusting margin of the offset parameter s in order to adjust the current residue audio Rnew in the further.

Hereinafter, a method of changing the adjusting margin of the offset parameter s and updating the offset parameter s by the adjusting unit 275 when the feedback audio F and the stored residue audio Rold are highly correlated will be illustrated with reference to FIG. 7.

Figure 7:
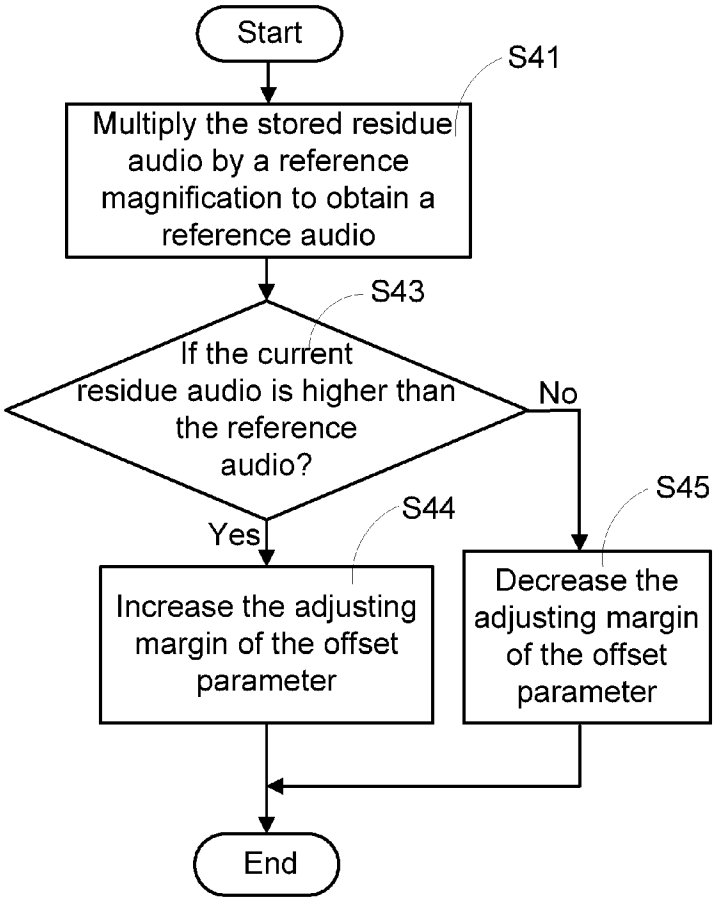
FIG. 7 is a flowchart illustrating the adaptive adjusting process performed by the adjusting unit of the acoustic processing apparatus of the present invention.

FIG. 7 is a flowchart illustrating the adaptive adjusting process performed by the adjusting unit of the acoustic processing apparatus of the present invention. The method of changing the adjusting margin of the offset parameter s and updating the offset parameter s by the adjusting unit 275 includes the following steps.

Firstly, in the step S41, the stored residue audio Rold is multiplied by a reference magnification m to obtain a reference audio E according to formula (2): E=Rold×m, where m is 0~1.

Then, the current residue audio Rnew is compared with the reference audio E (Step S43). According to the result about the comparison between the current residue audio Rnew and the reference audio E, the adjusting margin of the offset parameter s is modified.

For example, if the current residue audio Rnew is higher than the reference audio E (Rnew>E), the adjusting margin of the offset parameter s is increased by the adjusting unit 275 (Step S44). Whereas, if the current residue audio Rnew is lower than the reference audio E (Rnew<E), the adjusting margin of the offset parameter s is decreased by the adjusting unit 275 (Step S45).

The method of modifying adjusting margin of the offset parameter s by the adjusting unit 275 according to the result about the comparison between the current residue audio Rnew and the reference audio E will be illustrated with reference to FIG. 8.

Figure 8:
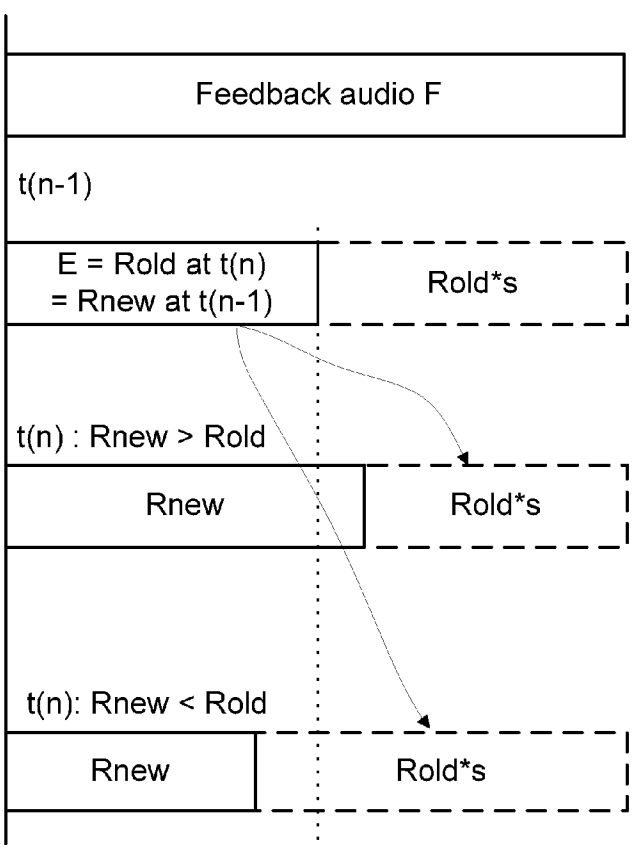
FIG. 8 schematically illustrates the comparison between the feedback audio and the current residue audio at the time spot t(n−1) and the time spot t(n).

FIG. 8 schematically illustrates the comparison between the feedback audio and the current residue audio at the time spot t(n−1) and the time spot t(n).

The first row of FIG. 8 indicates the feedback audio F transmitted from the microphone to the input unit. Since the difference between the sound volumes of the same user at different time spots is substantially identical, the feedback audio F received by the microphone for a certain time period is substantially identical. In accordance with the audio adjusting method of the present invention, the feedback audio F is considered as a comparison basis. Consequently, as shown in FIG. 8, the full length of each row is identical to the length of the first row.

The second row of the FIG. 8 denotes the current residue audio Rnew at the time spot t(n−1), which is obtained by deducting the product of the stored residue audio Rold and the offset parameter s at the time spot t(n) from the feedback audio F.

Moreover, the second row of FIG. 8 indicates how the current residue audio Rnew at the time spot t(n−1) is used as the reference audio E. For clarification and brevity, it is assumed that the reference magnification m is 1. Consequently, the reference audio E=the stored residue audio Rold at the time spot t(n1)=the current residue audio Rnew at the time spot t(n−1).

According to the formula (1): Rnew=F−(s×Rold). Consequently, the second row of FIG. 8 denotes the current residue audio Rnew obtained at the time spot t(n−1).

From the above discussions, the current residue audio Rnew obtained at the time spot t(n−1) is recorded into the storing unit 271. Moreover, the current residue audio Rnew obtained at the time spot t(n−1) is used as the stored residue audio Rold at the time spot t(n). Moreover, as indicated by the arrows, the current residue audio Rnew obtained at the time spot t(n−1) may be further utilized at the time spot t(n).

As shown in the third row of FIG. 8, the current residue audio Rnew at the time spot t(n) is higher than the reference audio E. As shown in the fourth row of FIG. 8, the current residue audio Rnew at the time spot t(n) is lower than the reference audio E. The solid segments in the left sides of the third row and the fourth row denote the current residue audio Rnew at the time spot t(n). The dotted segments in the right sides of the third row and the fourth row denote the product of the stored residue audio Rold and the offset parameter s at the time spot t(n), which is the magnitude to be deducted by the feedback audio F.

By comparing the reference audio E of the second row of FIG. 8 with the current residue audio Rnew of the third row, the current residue audio Rnew at the time spot t(n) is higher than the reference audio E. It means that the magnitude s×Rold to be deducted by the feedback audio F at the time spot t(n) is insufficient.

According to the formula (1), the current residue audio Rnew at the time spot t(n) is influenced by the current residue audio Rnew and the offset parameter s at the time spot t(n−1). Similarly, the current residue audio Rnew at the time spot t(n+1) is influenced by the adjusting margin of the offset parameter s at the time spot t(n). According to the situation as shown in the third row of FIG. 8, the adjusting margin of the offset parameter s is modified, so that the offset parameter s is increased.

Moreover, since the adjusting margin of the offset parameter s is largely adjusted at the time spot t(n), after a higher fraction of the stored residue audio Rold is deducted from the feedback audio F at the time spot t(n+1), the current residue audio Rnew at the time spot t(n+1) is obtained.

That is, since a higher fraction of the stored residue audio Rold is deducted from the feedback audio F when the current residue audio Rnew is calculated at the time spot t(n+1), the magnitude of the current residue audio Rnew at the time spot t(n+1) is largely decreased. Under this circumstance, the problem about the insufficient magnitude s×Rold to be deducted by the feedback audio F at the time spot t(n) will be overcome.

By comparing the reference audio E of the second row of FIG. 8 with the current residue audio Rnew of the fourth row, the current residue audio Rnew at the time spot t(n) is lower than the reference audio E. It means that the magnitude s×Rold deducted by the feedback audio F is excessive.

Meanwhile, the adjusting margin of the offset parameter s is decreased by the adjusting unit 275. Consequently, the magnitude of the stored residue audio Rold deducted from the feedback audio F at the time spot t(n+1) is lower than the magnitude of the stored residue audio Rold deducted from the feedback audio F at the time spot t(n).

That is, when the current residue audio Rnew is calculated at the time spot t(n+1), the offset parameter s had been slightly modified at the time spot t(n).

In comparison with the situation at the time spot t(n), since the offset parameter s is slightly modified at the time spot t(n+1), a lower fraction of the stored residue audio Rold is deducted from the feedback audio F.

That is, when the current residue audio Rnew at the time spot t(n+1) is calculated by the computing unit, the magnitude s×Rold deducted from the feedback audio F is slightly lower than the magnitude s×Rold deducted from the feedback audio F at the time spot t(n). Consequently, the magnitude of the current residue audio Rnew at the time spot t(n+1) is slightly higher than the magnitude of the current residue audio Rnew at the time spot t(n). Under this circumstance, the magnitude of the current residue audio Rnew at the time spot t(n+1) is relatively closer to the reference audio E.

From the above descriptions, if the feedback audio F and the stored residue audio Rold are highly correlated, the adjusting unit 275 not only calculates the current residue audio Rnew but also modifies the adjusting margin of the offset parameter s.

After the adjusting margin of the offset parameter s is modified by the adjusting unit 275, the offset parameter s in the storing unit 271 is modified to the modified offset parameter s'. The modified offset parameter s' is stored in the storing unit 271 is used in the subsequent calculation.

Since the adjusting margin of the offset parameter s is dynamically modified by the acoustic processing apparatus according to the current residue audio Rnew and the reference audio E, the offset parameter is adaptively adjusted. Consequently, the magnitude Rold×s is deducted from the feedback audio F. In other words, the current residue audio Rnew can quickly and accurately approach to the target audio.

Optionally, the acoustic processing apparatus 27 may further includes a gain unit (not shown). The gain unit is arranged between the storing unit 271 and the output unit 279 for providing an auto gain control (AGC) function. After the current residue audio Rnew is multiplied by a gain value (e.g. amp), the stored residue audio Rold is correspondingly updated.

Since the audio adjusting method of the present invention is adaptively performed according to the background environment, the distance between the microphone and the speaker is not restricted.

Regardless of whether the distance between the microphone and the speaker is far or near (e.g. a short distance of 15 centimeters or a far distance of 10 meters), the audio adjusting method of the present invention can dynamically find out the suitable adjusting margin of the offset parameter s. Consequently, a suitable current residue audio Rnew is obtained.

From the above descriptions, the use of the acoustic processing apparatus of the present invention can reduce the interference of the background audio from the speaker in order to prevent generation of the howling sound. In addition, the acoustic processing apparatus of the present invention can be applied to various types of microphones. For example, the acoustic processing apparatus of the present invention can be applied to a high sensitivity microphone, a condenser microphone, a non-condenser microphone, a directional microphone or an omni-directional microphone.

Moreover, by using the audio adjusting method of the present invention, it is not necessary to hold the microphone by hand, adjust the sound volume of the microphone or adjust the distance between the speaker and the microphone. Consequently, the utilization flexibility of the sound reinforcement system is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An audio adjusting method for an acoustic processing apparatus, the acoustic processing apparatus being electrically connected with a microphone and a speaker, the audio adjusting method comprising steps of:

receiving a feedback audio from the microphone;

calculating a current residue audio according to the feedback audio, a stored residue audio and an offset parameter;

updating the stored residue audio with the current residue audio;

performing a correlation calculation to find out a relationship between the feedback audio and the stored residue audio;

selectively modifying the offset parameter according to a result of the correlation calculation;

storing the modified offset parameter; and outputting the current residue audio to the speaker.

2. The audio adjusting method as claimed in claim 1, wherein the step of selectively modifying the offset parameter according to the result of the correlation calculation comprises sub-steps of:

if the result of the correlation calculation does not comply with a preset criterion, maintaining the offset parameter; and if the result of the correlation calculation complies with the preset criterion, performing an adaptive adjusting process to modify the offset parameter.

3. The audio adjusting method as claimed in claim 2, wherein the preset criterion is satisfied when a correlation coefficient about the relationship between the feedback audio and the stored residue audio is higher than or equal to a predetermined threshold value.

4. The audio adjusting method as claimed in claim 2, wherein the adaptive adjusting process comprising steps of:

multiplying the stored residue audio by a reference magnification to obtain a reference audio;

if the current residue audio is higher than the reference audio, increasing an adjusting margin of the offset parameter; and if the current residue audio is lower than the reference audio, decreasing the adjusting margin of the offset parameter.

5. An acoustic processing apparatus electrically connected with a microphone and a speaker, the acoustic processing apparatus comprising:

an input unit, for receiving a feedback audio from the microphone;

a storing unit, for storing a stored residue audio and an offset parameter;

a computing unit, electrically connected with the input unit and the storing unit, for calculating a current residue audio according to the feedback audio, the stored residue audio and the offset parameter, and performing a correlation calculation to find out a relationship between the feedback audio and the stored residue audio;

an adjusting unit, electrically connected with the computing unit, for selectively modifying the offset parameter according to a result of the correlation calculation; and an output unit, electrically connected with the computing unit, for outputting the current residue audio to the speaker.

6. The acoustic processing apparatus as claimed in claim 5, wherein the stored residue audio is updated with the current residue audio by the storing unit, and the modified offset parameter is stored in the storing unit.

7. The acoustic processing apparatus as claimed in claim 5, wherein if the result of the correlation calculation does not comply with a preset criterion, the offset parameter is maintained by the adjusting unit, wherein if the result of the correlation calculation complies with the preset criterion, an adaptive adjusting process is performed by the adjusting unit to modify the offset parameter.

8. The acoustic processing apparatus as claimed in claim 7, wherein the adjusting unit compares the stored residue audio with a reference audio in the adaptive adjusting process, wherein if the current residue audio is higher than the reference audio, an adjusting margin of the offset parameter is increased by the adjusting unit, wherein if the current residue audio is lower than the reference audio, the adjusting margin of the offset parameter is decreased by the adjusting unit.

9. The acoustic processing apparatus as claimed in claim 8, wherein the reference audio is equal to a product of the stored residue audio and a reference magnification.

10. The acoustic processing apparatus as claimed in claim 5, wherein the microphone is a high sensitivity microphone, a condenser microphone, a non-condenser microphone, a directional microphone or an omni-directional microphone.

* * * * *